United States Patent [19]

Takimoto et al.

[11] 4,168,163

[45] Sep. 18, 1979

[54] PARTICLE MIGRATION TYPE SENSITIVE MATERIALS AND METHOD OF USING THE SAME

[75] Inventors: Masaaki Takimoto; Takekazu Takashima, both of Asaki, Japan

[73] Assignee: Fuji Photo Film Co., Ltd., Minami-ashigara, Japan

[21] Appl. No.: 841,421

[22] Filed: Oct. 12, 1977

Related U.S. Application Data

[63] Continuation of Ser. No. 684,211, Oct. 12, 1976, abandoned.

[30] Foreign Application Priority Data

May 8, 1975 [JP] Japan ..... 50-54256

[51] Int. Cl.[2] ..... G03G 13/22; G03G 5/14

[52] U.S. Cl. ..... 96/1 PS; 96/1.5 R; 96/1.8

[58] Field of Search ..... 96/1 PS, 1 R, 1.5 R, 96/1.8

[56] References Cited

U.S. PATENT DOCUMENTS

| | | | |
|---|---|---|---|
| 3,520,681 | 7/1970 | Goffe | 96/1 PS |
| 3,672,988 | 6/1972 | Tamai et al. | 96/1.5 |
| 3,720,513 | 3/1973 | Gundlach | 96/1 PS |
| 3,743,537 | 7/1973 | Honjo et al. | 96/1.5 |
| 3,871,881 | 3/1975 | Mikelsons | 96/1.5 |
| 3,944,417 | 3/1976 | Lind | 96/1.5 |

*Primary Examiner*—Roland E. Martin, Jr.
*Attorney, Agent, or Firm*—Sughrue, Rothwell, Mion, Zinn and Macpeak

[57] ABSTRACT

In a method of making sensitive material for use in an image forming process which comprises uniformly charging the surface of a sensitive layer formed on a base and composed of an electrical insulator and photoconductive particles, subsequently exposing the charged surface to an optical image, and dissolving the electrical insulator with an organic solvent to selectively remove the photoconductive particles, the improvement which comprises using a base where at least one side of which is to be in contact with the sensitive layer is treated with a liquid containing a non-volatile material comprising colloidal alumina. The material as described is also claimed.

17 Claims, No Drawings

PARTICLE MIGRATION TYPE SENSITIVE MATERIALS AND METHOD OF USING THE SAME

This is a Continuation of application Ser. No. 684,211, filed Oct. 12, 1976, now abandoned.

BACKGROUND OF THE INVENTION

1. Field of the Invention

The present invention relates to particle migration type sensitive materials and to a method of making the same, more specifically, to a method of making sensitive materials for use in photoelectrosolography as described in U.S. Pat. No. 3,520,681, hereby incorporated, and to such materials.

2. Description of the Prior Art

The image forming process described in the above patent utilizes a sensitive material or layer provided on a conductive base plate which material or layer comprises a dispersion of sensitive particles in a material which is an electrical insulator and is either softenable or soluble in a solvent. The surface of the sensitive member is uniformly charged in the dark, and, after exposure to an optical image, development is carried out by bringing the sensitive layer into contact with a solvent capable of dissolving the same. The development is effected by selectively migrating the sensitive particles in accordance with the image, and reproduction of either a negative-to-positive image or a positive-to-positive image is determined by a combination of various factors, and although it is difficult to express general rules relevant thereto, the various factors include the sensitive powder, soluble material and developing solvent with respect to the material, and also the charging voltage, charging polarity and exposure intensity with respect to the processing conditions. Various publications describe these factors in detail, for example, Japanese Patent Publication 11,631/71, German Pat. No. 1,772,270 and Belgian Pat. No. 714,068. In the reproduction of either a negative-to-positive image or a positive-to-positive image, the key for a successful image forming process lies in the faithful development of a latent image obtained through charging and exposure.

In photoelectrosolography, as mentioned, a conductive base plate is generally required. As far as this point is concerned, such is common to conventional electrophotographic sensitive materials and electrostatic recording materials, however, a photoelectrosolographic sensitive material is widely different from these two types of materials in the point that its sensitive layer is destroyed at the time of development and the sensitive powder itself serves as developing particles. Moreover, upon termination of the development, the conductive base itself serves as an image carrier, so that there occurs a high interaction between the sensitive developing particles and the base. It is impossible, therefore, to produce photoelectrosolographic sensitive materials solely based upon conventional knowledge in electrophotography or electrostatic recording. Heretofore, as the conductive base to support a sensitive material in electrophotography or electrostatic recording, a variety of plates have been effectively used including metal plates and paper or plastic films treated to render the same conductive. However, satisfactory images have not been obtainable by the simple transfer of such conductive base plates to photoelectrosolographic sensitive materials since disadvantages such as high background density (fog), low maximum image density and low overall contrast are obtained with such a conductive base plate.

SUMMARY OF THE INVENTION

One object of the present invention is to provide photoelectrosolographic sensitive materials that have low background density and high image contrast, i.e., the present invention relates to improved sensitive materials and to an improved method of making sensitive materials for use in an image forming process which comprises uniformly charging the surface of a sensitive layer formed on a base, which sensitive layer comprises an electrical insulator and photoconductive particles, subsequently exposing the charged surface to an optical image, and dissolving the electrical insulator with an organic solvent to selectively remove the photoconductive particles, where the method is characterized by treating at least the side of the base which is to be in contact with the sensitive layer with a treatment liquid containing a non-volatile material principally comprising colloidal alumina.

DETAILED DESCRIPTION OF THE INVENTION

Photoelectrosolographic sensitive materials may be considered as comprising a sensitive layer and a base.

The photoelectrosolographic sensitive layer contains at least an electrical insulator which is soluble in an organic solvent and a photoconductive powder. As the electrical insulator soluble in an organic solvent, a variety of natural resins and synthetic resins can be used. Typical ones are rosin and esters thereof, rosin derivatives such as hydrogenated rosin and esters thereof, dammar, cumarone-indene resins, aliphatic petroleum hydrocarbon resins such as Arkon P-100 (Arakawa Rinsan), polystyrene, sytrene-olefin copolymers such as styrene-butadiene copolymers, silicone resins, alkyd resins, epoxy resins, epoxy esters, polyalkyl acrylates, polyalkyl methacrylates, and styrene-alkyl methacrylate copolymers Plasticizers may be added thereto so as to enhance the effects of the above resins, if desired, e.g., triphenyl phosphate, di-butyl phthalate, etc., preferably in an amount not more than 10% by weight.

Although various materials are already known for use as a photoconductive powder in combination with such a resin, it is preferred that the one used in this invention have a particle diameter on the order of the micron or submicron level, preferably less than about one micron, e.g., 1.0 micron to 0.1 micron. Typical inorganic photoconductive materials as may be used are zinc oxide, cadmium sulfide, titanium oxide, amorphous selenium, selenium-arsenic alloys and selenium-tellurium alloys. A variety of useful inorganic photoconductive materials are given in U.S. Pat. No. 3,121,006. Typical examples thereof are C.I. Pigment Yellow 12 (C.I. 21090), C.I. Vat yellow 1 (C.I. 70600), C.I. Pigment Red 81 (C.I. 45160), C.I. Pigment Red 144, C.I. Pigment Violet 19 (C.I. 46500), their quinacrydones, C.I. Pigment Blue 15 (C.I. 74160), C.I. Pigment Blue 16 (C.I. 74100), etc. Besides the above, many other inorganic photoconductors can be used such as triphenodioxadine as described in British Pat. No. 1,175,452, anthraquinone pigments as described in British Pat. No. 1,155,974, and quinone furan pigments as described in British Pat. Nos. 1,137,885 and 1,137,886.

As will be appreciated by one skilled in the art, a non-photoconductive organic or inorganic powder (such as colloidal silica) may be added to the sensitive layer to modify the surface shape of the layer or to facilitate the formation of the layer, if desired, and, in some cases, a surface active agent or viscosity increasing agent can be added to increase the dispersion stability of the photoconductive powder.

It is generally preferred that the base for the photoelectrosolographic sensitive material be conductive. Accordingly, typical useful substances include metals such as aluminum, copper, silver or gold; a glass or resinous film with a thin layer of aluminum, palladium, copper, silver, gold or tin oxide thereon; and paper treated to render the same conductive. To render a paper conductive, all of the agents generally employed in the electrophotographic field can be used, and particularly effective are polyvinyl benzyl trimethyl ammonium chloride, poly(N,N-dimethyl-3,5-methylene piperydium chloride), polyvinyl benzene sulfonic sodium salt, and colloidal alumina as is used in the present invention. Even when the base is non-conductive, it is possible to charge the sensitive member by carrying out positive and negative corona discharge from both the sensitive layer side and reverse sides of the sensitive member, as is known in the electrophotographic field.

With regard to other physical properties of the base, high light transmissivity is required in some cases to obtain a transparency.

The foregoing is a general explanation on the base, which is well known in the manufacture of existing electrophotographic sensitive materials and electrostatic recording materials. However, in photoelectrosology, as already described, the base serves as a support for the sensitive layer and further as an image carrier, so that a preferred base cannot be produced from a consideration of only the aforementioned factors. Considering such circumstances, the present invention provides a remarkably effective base for an photoelectrosolographic sensitive material by treating a base as described with a liquid containing a non-volatile material which comprises colloidal alumina. Colloidal alumina is extremely effective in lowering the optical background density and also to increase the image contrast in the photoelectrosology. Although colloidal alumina itself is known as a treatment agent to render paper conductive as mentioned above, its effects in photoelectrosology could not have been predicted.

Colloidal alumina is commercially available in the form of an aqueous liquid dispersion, some examples of which are Aluminasol 100, Aluminasol 200 and Aluminasol 300 manufactured by Nissan Chemical Company, and Baymarl manufactured by E. I. DuPont Company.

It is often said that colloidal alumina is composed of amorphous particles of aluminum oxide whose surface is in the form of a hydroxide, but since no peak appears in its X-ray diffraction image in most cases, it is also regarded as a hydrate of an oxide or a hydroxide.

Aqueous liquid dispersions of collodial alumina typically have a pH of about 3 to about 5 and have a positive electric charge. Manufacturing methods and properties of colloidal alumina are given in *Inorganic Colloid Chemistry,* Vol. 2 (1935) by H. B. Weiser. It is already been mentioned that the provision of a conductive base is generally preferred in photoelectrosology. Since colloidal alumina functions as a conductive agent, the base to be treated with a liquid containing colloidal alumina may either be conductive or non-conductive. That is, in the case of a conductive base composed of a metal or coated with a thin layer of evaporated metal, it may be overcoated with the liquid containing colloidal alumina, while in the case of a paper base rendered conductive, at least the one side which supports the sensitive layer may be treated with the liquid containing colloidal alumina. When the base to be treated is non-conductive, such as paper or a resinous film, treatment with a liquid containing colloidal alumina is capable of simultaneously giving both conductivity and adaptability for use in photoelectrosology, which is the object of the present invention. In the case of paper, the simultaneous use of a treatment agent for conduction of paper is also a preferred embodiment of this invention. The treatment of paper is effected by coating it with the liquid, or by impregnation with the liquid during paper manufacturing. In this case, non-volatile components (other than colloidal alumina) should be not more than 60 wt% of the coating or impregnating liquid. After drying, the amount of colloidal alumina coated is about 0.01 g to about 10 g per centiare (square meter).

The treatment liquid for use in the present invention contains colloidal alumina as a non-volatile material, of which component amount about 5% by weight or more is sufficient to attain a reduction in optical background density and an increase of image contrast to a perceptible degree.

A preferred treatment liquid in accordance with the present invention contains, as a non-volatile material, colloidal alumina in an amount of 40% by weight or more.

The amount of colloidal alumina applied ranges from about 0.01 to about 10 g, more preferably from 0.1 to 5 g, per centiare of the base to be treated.

Other non-volatile materials may also be added to the treatment liquid (preferably in an amount not more than 60 wt%) that contains colloidal alumina, including agents for rendering a paper conductive such as polyvinyl benzyl trimethyl ammonium chloride, poly(N,N-dimethyl-3,5-methylene piperydium chloride), etc., if desired.

The treatment liquid can further contain water soluble resins such as gelatin, casein or polyvinyl alcohol; alcohol soluble resin such as polyvinyl acetal or polyvinyl butyral; or resin-water emulsions such as styrene/-butadiene copolymer latexes or butadiene/methacrylic acid methyl copolymer latexes. Other agents can also optionally be added, for example, lower polyhydric alcohols such as ethylene glycol, glycerin or pentaerythritol, and copolymers thereof. It will be obvious that a surface active agent (particularly a cationic or nonionic surface active agent) can be added to the treatment liquid, if desired. Furthermore, colloidal silica can also be added.

Since colloidal alumina is available generally in the form of an aqueous dispersion liquid, the treatment liquid is generally produced using water or an organic solvent miscible with water. Although usable solvents will differ depending upon the type of optional additives used, generally effective ones are lower aliphatic alcohols such as methyl alcohol, ethyl alcohol, propyl alcohol or butyl alcohol; acetone, dioxane, ethyl ether, and ethylene glycol monomethyl ether.

The average size of the colloidal alumina is generally about 50 mμ×10 mμ to about 100 mμ×10 mμ since colloidal alumina of this size is easily obtained.

Considered from the viewpoint of the base at least the one side of which is to be in contact with a sensitive layer is treated with the liquid that principally comprises colloidal alumina, the present invention can be broadly divided into the following modes:

(1) When the base is paper, a resinous film or glass which has not been treated to render the same conductive, at least one side thereof is treated according to the present invention, and a sensitive layer is formed thereon.

(2) When the base is composed of a laminate consisting of paper and a resinous film which has not been treated to render the same conductive, at least one side (either or both sides can be used) is treated according to the present invention, and a sensitive layer is formed thereon.

(3) When the base is paper at least one side of which has already been treated to render the same conductive, its other side is treated according to the present invention, and a sensitive layer is formed thereon.

(4) When the base is paper or a laminate of paper and resinous film where both sides have been treated to render the same conductive, at least one side is treated according to the present invention, and a sensitive layer is formed thereon.

(5) When the base is metal or another substance having a conductivity equal to metal, at least one side is treated according to the present invention, and a sensitive layer is formed thereon.

(6) When the base is glass or a resinous film where one or both sides are covered with a thin layer of evaporated metal, the thin layer of evaporated metal on one or both sides of the base is treated according to the present invention, and a sensitive layer is formed thereon.

(7) When the base has a thin layer of evaporated metal or a transparent conductive layer, e.g., tin oxide, indium oxide, copper iodide, etc., e.g., either of such layers being not more than 0.5μ thick, on one or both sides thereof and the light transmissivity is above 10%, the conductive layer on one or both sides of the base is treated according to the present invention, and a sensitive layer is formed thereon.

(8) During the step of manufacturing paper or a resinous film, it can be impregnated or filled with colloidal alumina, e.g., in an amount of 0.1 to 20% based on the paper or resin weight, and a sensitive layer formed on the base.

Using a base to which the procedure of the present invention has been applied, a photoelectrosolographic sensitive material is obtained by known procedures. One typical method comprises dissolving an electrical insulator into a solvent which is to be used for the sensitive layer, mechanically dispersing the photoconductive particles into the solution, and coating the base with the dispersion thus obtained. Another method comprises, as is described in U.S. Pat. No. 3,250,681, scattering photoconductive particles uniformly on the surface of an electrical insulator previously provided on a base, subsequently softening the electrical insulator by heating or a solvent vapor, and burying the photoconductive particles into the softened electrical insulator.

The thickness of the sensitive layer of the sensitive material of the present invention generally ranges from about 0.5 to about 20μ. The minimum thickness is determined on the basis of attaining a satisfactory image contrast, while the maximum thickness is determined from the requirement that no image distortion occur in short-time development. To maintain a proper image contrast, it is preferred that the ratio of the photoconductive powder to the electrical insulator be selected so as to be within a range from about 10:1 to about 1:300, preferably 1:1 to 1:20, by weight. Preferred electrical insulators have an intrinsic viscosity of about 0.3 or less.

The image forming process according to the present invention starts with uniformly charging the surface of the sensitive material by corona discharge. This charging step is carried out by conventional methods well known in the electrophotographic field. The sensitive material is then image-wise exposed to light. The light is normally irradiated directly onto the sensitive layer, but in the case the base is transparent, exposure may be performed through the base. It will be obvious to one skilled in the art that any light source can be used so long as its light is in the wavelength range absorbable by the photoconductive powder so as to render the particles conductive.

Subsequently, the sensitive material is gently immersed in a solvent that is capable of dissolving the electrical insulator used to form the sensitive layer, thereby softening and dissolving the electrical insulator and simultaneously selectively removing the photoconductive particles according to the image. Whether the photoconductive particles are removed from exposed areas or from non-exposed areas in this step cannot be unequivocally stated by a general rule, as described in the foregoing, but one skilled in the art applying the normal skill of the art will be able to determine appropriate materials/conditions to obtain the desired effect. However, some exemplary cases will be given.

Since there are various substances for the electrical insulator contained in the sensitive layer as already mentioned, it is necessary to select a good solvent suited for the individual substance. A preferred solvent is one that has a specific resistance greater than about $10^{10}$ ohms.centimeter. Examples thereof are trichloroethylene, chloroform, benzene, toluene, xylene, cyclohexane, pentane, n-heptane, gasoline, light oil, kerosene, and isoparaffinic solvents (such as Isopar E, G and H made by Esso Standard Oil Company). These solvents may be used individually or in the form of a mixture thereof. It is also permissable to immerse the sensitive material continuously in a solvent or a mixture thereof.

Hereinafter the present invention will be described in further detail with reference to some embodiments.

In the following Examples, the size of the colloidal alumina used was:

Aluminasol 100 (made by Nissan Chemical Company), average size of 100 mμ × 10 mμ (Aluminasol 100 was used in Examples 2, 4, 5, 6 and 7); or Aluminasol 200 (made by Nissan Chemical Company), average size of 50 mμ × 10 mμ (Aluminasol 200 was used in Examples 1 and 3).

The balance of the coating liquid (percentage by weight) was:

(a) In Examples 1 and 3: About a 10% aqueous dispersion liquid of aluminasol 200 was diluted with methyl alcohol to give a 3% colloidal alumina dispersion;

(b) In Examples 2, 6 and 7: A 10% aqueous dispersion liquid of Aluminasol 100 and a 30% aqueous solution of ECR-34 (made by Dow Chemical Company) were diluted with methyl alcohol to give an 8% dispersion solution thereof, respectively, and then mixed according to each ratio in Examples 2, 6 and 7;

(c) In Examples 4 and 5: A 10% aqueous dispersion liquid (Aluminasol 100) of colloidal alumina and a 30% aqueous solution (ECR-34) of polyvinyl benzyl trimethyl ammonium chloride were diluted with a mixed solution of water and methyl alcohol (water/methyl alcohol=1/1) to give an 8% dispersion solution thereof, respectively, and then mixed according to each ratio in Examples 4 and 5.

In the following, rod coating was used for coating a paper base, and a dip coating was used for coating other bases except paper, that is, resinous film and thin layer of evaporated metal, etc. These coating methods were used for both the aqueous dispersion liquid of colloidal alumina and the suspension liquid to form the sensitive layer.

EXAMPLE 1

A toluene solution containing 40% by weight hydrogenated rosin (Stabelite resin made by Hercules Company) was prepared. 1 part by weight copper phthalocyanine (C.I. Pigment Blue 15) was dispersed into 25 parts by weight of this toluene solution using a stand mill, and the mixture was kneaded for 10 hours in a porcelain ball mill to produce a blue suspension liquid. Using a base obtained by evaporating aluminum (ca. 1μ thick) onto one surface of a polyethylene terephthalate film, the thin layer of evaporated aluminum was dip coated with the suspension liquid to form a sensitive layer in a thickness of about 5μ after dyring (Sample A). In the meantime, prior to forming the sensitive layer, a colloidal alumina layer was provided on the thin layer of evaporated aluminum, and then the sensitive layer was formed thereon as described above by coating to produce a sensitive material (Sample B). With respect to the colloidal alumina, an aqueous dispersion liquid (Aluminasol 200 made by Nissan Chemical Company) was diluted with methyl alcohol and was applied so that after drying the colloidal alumina remained at the rate of about 0.5 g per centiare on the thin layer of evaporated aluminum.

The surface of the sensitive layer of each of Samples A and B was charged at −200 volts in the dark by corona discharge, and, using a light source having a luminous intensity of 200 lux on the sensitive layer surface, exposure was performed through a negative image for 10 seconds. The sensitive material was thereafter immersed for 10 seconds in a liquid containing xylene and kerosene (room temperature) at a mixture ratio of 1:1 by volume, and thus a positive image was obtained. Sample B (treated with the colloidal alumina) had a remarkably lower background density and an approximately equal maximum image density as compared to Sample A (untreated) so that the image contrast was higher in Sample B. in this example, since the base had a "mirror" surface, it was difficult to measure the image density with a commercial densitometer. Therefore, the results of visual observation with the naked eye are given above.

EXAMPLE 2

Using 1 part by weight of Cromophtal Red BR (C.I. Pigment Red 144, made by Ciba Company) and a toluene solution containing 40% by weight of the glycerin ester of hydrogenated rosin (Estergam H made by Arakawa Rinsan Company), a red suspension liquid was obtained following the procedure of Example 1. For use as the base, the coated side of an art paper was treated as shown in Table 1.

TABLE 1

| Sample | Colloidal Alumina (ratio by weight) | : | Polyvinyl benzyl trimethyl ammonium chloride (ratio by weight) | Background Density | Maximum Image Density | Image Contrast |
|---|---|---|---|---|---|---|
| C | 0 | : | 5 | 0.23 | 0.58 | 0.35 |
| D | 1 | : | 4 | 0.20 | 0.60 | 0.40 |
| E | 2 | : | 3 | 0.16 | 0.56 | 0.40 |
| F | 3 | : | 2 | 0.19 | 0.81 | 0.62 |
| G | 4 | : | 1 | 0.19 | 1.11 | 0.92 |
| H | 5 | : | 0 | 0.19 | 1.13 | 0.94 |

An aqueous dispersion liquid (Aluminasol 100 made by Nissan Chemical Company) of colloidal alumina and an aqueous solution (ECR-34 made by Dow Chemical Company) of polyvinyl benzyl trimethyl ammonium chloride were both diluted with methyl alcohol, and were coated individually or in the form of a mixture on the base. Non-volatile material was present in the aqueous dispersion or solution liquids so that amount of 2 g per centiare was left on the base. The reverse side of the art paper was treated to render the same conductive by coating polyvinyl benzyl trimethyl ammonium chloride (ECR-34 made by Dow Chemical Company) thereon at a rate of 1.0 g per centiare.

The red suspension liquid was then applied to each base such that the thickness after drying became about 5μ. The surface of the sensitive layer of each sample was charged at −350 volts by corona discharge, and, using a light source having a luminous intensity of 2,000 lux on the sensitive layer surface, exposure was performed through a negative image for 10 seconds. The sensitive material was then immersed in xylene (room temperature) for about 3 seconds, and, after washing with kerosene, a positive image was obtained. Table 1 gives a summary of the background density, maximum image density and image contrast for each Sample, showing the differences between them. The density listed denotes the value measured through a green filter. From the results of the measurements, colloidal alumina was found to be remarkably effective in increasing image contrast.

EXAMPLE 3

Metal layers were produced by evaporating gold, silver, copper, nickel, chrome, iron, aluminum and palladium onto polyethylene terephthalate films. Each thin layer of evaporated metal (palladium was about 0.1μ thick; metals except palladium were about 1μ thick) was coated with colloidal alumina (Aluminasol 200 made by Nissan Chemical Company) at a rate of 1.0 g (solids) per centiare. Then, the red suspension liquid obtained in Example 2 was applied onto the evaporated metal layer having the colloidal alumina layer thereon and also on the evaporated metal layer having no colloidal alumina layer in a manner such that each layer had a thickness of about 5μ after drying. An image was obtained in each case following the procedure of Example 2. The image was evaluated with the naked eye due to the same reason given in Example 1. With respect to each evaporated metal film, colloidal alumina was proven to be effective in reducing the background density, and thus it enhanced the image contrast. In the same operation for a tin oxide layer formed on a glass plate, the treatment with colloidal alumina was proven to be effective in increasing the image contrast.

EXAMPLE 4

One side of high quality paper weighing 90 g per centiare was so treated so that 4 g per centiare of the non-volatile material of the composition given in Table 2 was left thereon (after drying), while the other side was so treated that polyvinyl benzyl trimethyl ammonium chloride was left thereon at a rate of 2.0 g per centiare (after drying). As the colloidal alumina Aluminasol 100 (made by Nissan Chemical Company) was employed. A sensitive layer was formed by the procedure of Example 1 on each of the treated surfaces listed in Table 2, and the element was then processed to obtain an image by the procedure of Example 1. Table 2 gives a summary of the background density, maximum image density and image contrast measured with red light for each Sample.

TABLE 2

| Sample | Polyvinyl* Alcohol | : | Polyvinyl benzyl trimethyl ammonium chloride | : | Colloidal Alumina | Background Density | Maximum Image Density | Image Contrast |
|---|---|---|---|---|---|---|---|---|
| | (ratio by weight) | | | | | | | |
| I | 1 | : | 1 | : | 0 | 0.35 | 0.85 | 0.50 |
| J | 1 | : | 1 | : | 1 | 0.30 | 1.04 | 0.74 |
| K | 1 | : | 1 | : | 2 | 0.18 | 1.10 | 0.92 |

*Molecular weight of polyvinyl alcohol: 500

EXAMPLE 5

One side of a high quality paper weighing 100 g per centiare had laminated thereto a 30μ thick polyethylene layer, which was then finished to have a mirror surface or a mat surface. The remaining paper surface was coated with polyvinyl benzyl trimethyl ammonium chloride at the rate of 2.0 g per centiare (after drying). The polyethylene surface was then coated so that a layer of the composition at the mixture ratio given in Table 3 was formed thereon at the rate of 1.5 g per centiare (after drying). As the colloidal alumina, Aluminasol 100 (made by Nissan Chemical Company) was employed. 1 part by weight of quinacrydone C.I. Pigment Violet (C.I. 46500) was mixed by the procedure of Example 1 with 25 parts by weight of a toluene solution containing 40% by weight dehydrogenated rosin (Rondis R made by Arakawa Rinsan Company), and the mixture was applied onto the polyethylene-coated side of each of the bases shown in Table 3 in a manner such that the thickness after drying became about 5μ.

The sensitive layer surface was charged at +800 volts and then exposed through a positive image for 10 seconds at a luminous intensity at the layer surface of 2,000 lux. Subsequently, the sensitive material was immersed in 1,1,1-trichloroethane (room temperature) for 3 seconds, and, after washing with kerosene, a positive image was produced. Table 3 gives a summary of the background density, maximum image density and image contrast obtained with green light for each material.

TABLE 3

| Sample | Polyvinyl benzyl trimethyl ammonium chloride | : | Colloidal Alumina | Background Density | Maximum Image Density | Image Contrast |
|---|---|---|---|---|---|---|
| | (ratio by weight) | | | | | |
| L | None | | | Irregular spots unrelated to image | | |

TABLE 3-continued

| Sample | Polyvinyl benzyl trimethyl ammonium chloride | : | Colloidal Alumina | Background Density | Maximum Image Density | Image Contrast |
|---|---|---|---|---|---|---|
| | (ratio by weight) | | | | | |
| M | 5 | : | 0 | 0.42 | 0.83 | 0.41 |
| N | 1 | : | 4 | 0.20 | 1.16 | 0.96 |

EXAMPLE 6

Using the base of Samples C and G in Example 2, a sensitive layer was formed with different electrical insulator resins. The method of forming the sensitive layer was the same as in Example 1 except for the resins used.

Each sensitive layer surface was charged at −200 volts and then exposed through a positive image for 10 seconds at a luminous intensity of 200 lux at the sensitive layer surface. Subsequently, the sensitive material was immersed in toluene (room temperature) for 3 seconds, and, after washing with kerosene, an image was produced. Table 4 gives the results of measurements obtained with red light.

TABLE 4

| Resin | Base | Image | Background Density | Maximum Image Density | Image Contrast |
|---|---|---|---|---|---|
| Polystyrene* | C | Positive | 0.42 | 0.70 | 0.28 |
| | G | " | 0.22 | 1.32 | 1.10 |
| Copolymer 1* | C | Negative | 0.45 | 0.61 | 0.16 |
| | G | " | 0.30 | 1.02 | 0.72 |
| Copolymer 2* | C | " | 0.40 | 0.83 | 0.43 |
| | G | " | 0.28 | 0.97 | 0.69 |

*Molecular weights: Polystyrene : 500 Copolymer 1 : 3,000 Copolymer 2 : 3,000
Copolymer 1 : Methyl methacrylate/n-butyl methacrylate/maleic anhydride = 20/80/1.25 (molar)
Copolymer 2 : Styrene/hexyl methacrylate = 80/20 (molar)

EXAMPLE 7

1 part by weight of Cromophtal Yellow (C.I. Vat Yellow 1, C.I. 70600 made by Ciba Company) was dispersed by the method of Example 1 into 25 parts by weight of a toluene solution containing 40% by weight of the pentaerythritol ester of rosin (Pensel A made by Arakawa Rinsan Company), thereby producing a yellow suspension liquid. Each base of Samples C and G in Example 2 was coated with this suspension liquid in a manner such that the thickness after drying became about 5μ.

The sensitive layer surface was then charged at +400 volts in the dark, and then exposed through a positive image for 10 seconds at a luminous intensity of 200 lux at the sensitive layer surface. The sensitive material was then immersed in xylene (room temperature) for 3 seconds, and, after washing with a mixed solvent consisting of xylene and kerosene at a ratio of 2:3 by volume, a positive image was obtained. As a result of measurements with blue light, the image contrast on the sensitive layer of Sample C was 0.41, while that of Sample G was 1.03.

While the invention has been described in detail and with reference to specific embodiments thereof, it will be apparent to one skilled in the art that various changes and modifications can be made therein without departing from the spirit and scope thereof.

We claim:

1. In a method of making a sensitive material for use in an image forming process which comprises uniformly charging the surface of a sensitive layer formed on a base and composed of an electrical insulator and photoconductive particles, subsequently exposing the charged surface to an optical image, and dissolving the electrical insulator with an organic solvent to selectively remove the photoconductive particles; the improvement which comprises using a base at least the one side of which is to be in contact with the sensitive layer is treated with a liquid containing a non-volatile material comprising colloidal alumina said base being conductive prior to said treatment with colloidal alumina.

2. The method of claim 1, wherein said base is metal or a glass resinous film having thereon a thin metal layer.

3. The method of claim 2, wherein said electrical insulator is a natural or synthetic resin.

4. The method of claim 3, wherein said resin has an intrinsic viscosity of about 0.3 or less.

5. The method of claim 4, wherein the ratio of said photoconductive particles to said electrical insulator is from about 10:1 to about 1:300, by weight.

6. The method of claim 5, wherein said colloidal alumina is present in an amount of about 0.01 to about 10 g per centiare of said base.

7. In a photoelectrosolographic material which comprises a base carrying at least one sensitive layer thereon, which sensitive layer comprises an electrical insulator and photoconductive particles, the improvement where said base is treated with a liquid containing a non-volatile material principally comprising colloidal alumina, at least on the side of which contacts said at least one sensitive layer said base being conductive prior to said treatment with colloidal alumina.

8. The photoelectrosolographic material of claim 7, wherein said base is metal or a glass or resinous film having thereon a thin metal layer.

9. A photoelectrosolographic material as claimed in claim 8, wherein said electrical insulator is a natural or synthetic resin.

10. A photoelectrosolographic material as claimed in claim 9, wherein said resin has an intrinsic viscosity of about 0.3 or less.

11. A photoelectrosolographic material as claimed in claim 10, wherein the ratio of said photoconductive particles to said electrical insulator is from about 10:1 to about 1:300, by weight.

12. A photoelectrosolographic material as claimed in claim 11, wherein said colloidal alumina is present in an amount of about 0.01 to about 10 g per centiare of said base.

13. The method of claim 2, wherein said base is a metal and said metal is selected from the group consisting of aluminum, copper, silver or gold.

14. The method of claim 2, wherein said base is a glass or resinous film having thereon a thin metal layer of aluminum, palladium, copper, silver, gold or tin oxide.

15. The photoelectrosolographic material of claim 8, wherein said base is metal and said metal is selected from the group consisting of aluminum, copper, silver and gold.

16. A photoelectrosolographic material as claimed in claim 15, wherein said colloidal alumina is present in an amount of about 0.01 to about 10 g per centiare of said base.

17. The photoelectrosolographic material of claim 8, wherein said base is a glass or resin film having thereon a thin metal layer of aluminum, palladium, copper, silver, gold or tin oxide.

* * * * *